United States Patent [19]

Farrell

[11] Patent Number: 4,653,467

[45] Date of Patent: Mar. 31, 1987

[54] HEATERS

[75] Inventor: John C. Farrell, Auckland, New Zealand

[73] Assignee: Kent Heating Limited, Auckland, New Zealand

[21] Appl. No.: 735,680

[22] Filed: May 20, 1985

[30] Foreign Application Priority Data

May 18, 1984 [NZ] New Zealand ..... 208206

[51] Int. Cl.[4] ..... F24B 7/00

[52] U.S. Cl. ..... 126/126; 126/120; 126/315; 126/307 R

[58] Field of Search ..... 126/126, 120, 318, 317, 126/315, 314, 307 R, 82, 98, 123, 122, 301, 121; 32/218, 219; 98/58, 60

[56] References Cited

U.S. PATENT DOCUMENTS

| | | | |
|---|---|---|---|
| 12,491 | 3/1855 | Smith | 126/120 |
| 302,621 | 7/1884 | Clawson | 52/219 |
| 1,278,895 | 9/1918 | Farley | 126/315 |
| 1,546,503 | 7/1925 | Meier | 126/126 |
| 1,583,080 | 5/1926 | McCallum | 126/120 |
| 3,190,279 | 6/1965 | Davis | 126/120 |
| 3,271,914 | 9/1966 | Boyett | 126/120 |
| 3,880,139 | 4/1975 | Young | 126/126 |
| 3,952,721 | 4/1976 | Patterson | 126/126 |
| 4,026,264 | 5/1977 | Henriques | 126/120 |
| 4,159,016 | 6/1979 | Johnson | 126/120 |
| 4,266,525 | 5/1981 | Hall | 126/121 |
| 4,329,973 | 5/1982 | Scullin, Jr. | 126/120 |
| 4,385,622 | 5/1983 | Tidwell | 126/120 |
| 4,406,277 | 9/1983 | Risso | 126/126 |
| 4,437,451 | 3/1984 | Wysong | 126/123 |
| 4,527,541 | 7/1985 | Roberts | 126/318 |

FOREIGN PATENT DOCUMENTS

| | | | |
|---|---|---|---|
| 505441 | 11/1929 | Fed. Rep. of Germany | 126/98 |
| 2339215 | 2/1975 | Fed. Rep. of Germany | 126/120 |
| 656837 | 5/1929 | France | 126/82 |
| 1261404 | 4/1960 | France | 126/82 |
| 797229 | 6/1958 | United Kingdom | 126/120 |
| 849302 | 9/1960 | United Kingdom | 126/121 |
| 1291679 | 10/1972 | United Kingdom | 126/307 R |
| 1304778 | 1/1973 | United Kingdom | 126/120 |

*Primary Examiner*—Samuel Scott
*Assistant Examiner*—H. A. Odar
*Attorney, Agent, or Firm*—Holman & Stern

[57] ABSTRACT

This invention relates to improvements in heaters and more particularly to fireplace insert heaters.

The invention relates to a cabinet for such heaters which provides a removable panel which is slidable relative to remaining portions of the heater to enable access to a flue connection for a firebox of the heater to thus enable the heater to be readily installed or removed from an in situ flue installation. The invention provides a removeable portion of a wall of the cabinet which when removed facilitates access to and connection and disconnection of the flue.

5 Claims, 5 Drawing Figures

HEATERS

BACKGROUND TO THE INVENTION

This invention relates to those fireplace heaters which have a cabinet arranged to at least partially enclose the firebox and connected to a flue which passes up the fireplace chimney to convey combustion products out of the building. The front of a fireplace heater usually includes a firebox door surround assembly which extends over any openings between the firebox and the cabinet, and over any gaps which usually exist between the cabinet and the surrounding fireplace. Grilles may be provided in the surround assembly to allow air flow through these openings and gaps. A fireplace heater is a solid fuel heating appliance installed within, or partially within a fireplace, and includes those heaters sometimes known as fireplace inserts.

In the past the operation of connecting the flue to the heater has been problematical owing to the difficulty of access to the place where the flue meets the heater. In some cases the flue has been foreshortened or dispensed with altogether so that the heater could be installed without the flue having to be connected after installation. This practice carries a considerable risk of fire due to the build up of creosote and other combustion products in the chimney.

An alternative practice in the past has been to locate the flue in the chimney prior to installation of the heater. It was then necessary to drop or maneouvre the flue into its correct working position vis-a-vis the heater after installation of the latter and before installing the door surround assembly. This is unsatisfactory when the gap between the cabinet and the surrounding fireplace is too small to allow a satisfactory sealed connection between the heater and the flue to be made. The technique is also laborious and time consuming which is particularly undesirable because the flue should be disconnected at regular intervals to allow a visual inspection to be made for creosote build-up.

It is an object of the invention to provide a heater in which sealed connection between the flue and the heater is more easily achieved, particularly when screws or other mechanical means are used to make a positive connection.

SUMMARY OF THE INVENTION

According to the invention there is provided for a heater which is insertable in a fireplace and includes a firebox and means for connecting the heater to a flue for conveying products of combustion away from the firebox, a cabinet arranged to at least partially enclose the firebox and comprising at least one part which is movable when the cabinet is in situ to provide a space allowing access to the means for connecting the heater to the flue.

According to one aspect of the invention the movable part is an upper wall of the cabinet.

According to another aspect of the invention, the movable part is locatable wholly within the fireplace.

According to a feature of the invention, the cabinet includes a door surround assembly at least a portion of which is removable to allow access to the movable part. The cabinet may, according to another feature of the invention, include guide formations in which the movable part can be slidably mounted.

According to yet another aspect of the invention, the movable part can be entirely removed from the cabinet.

The movable part may, according to yet another feature of the invention, slope downwardly from the front to the rear of the heater.

DESCRIPTION OF THE DRAWINGS

An embodiment of the invention is described with reference to the accompanying drawings in which.

DETAILED DESCRIPTION OF THE INVENTION

Figure 1:
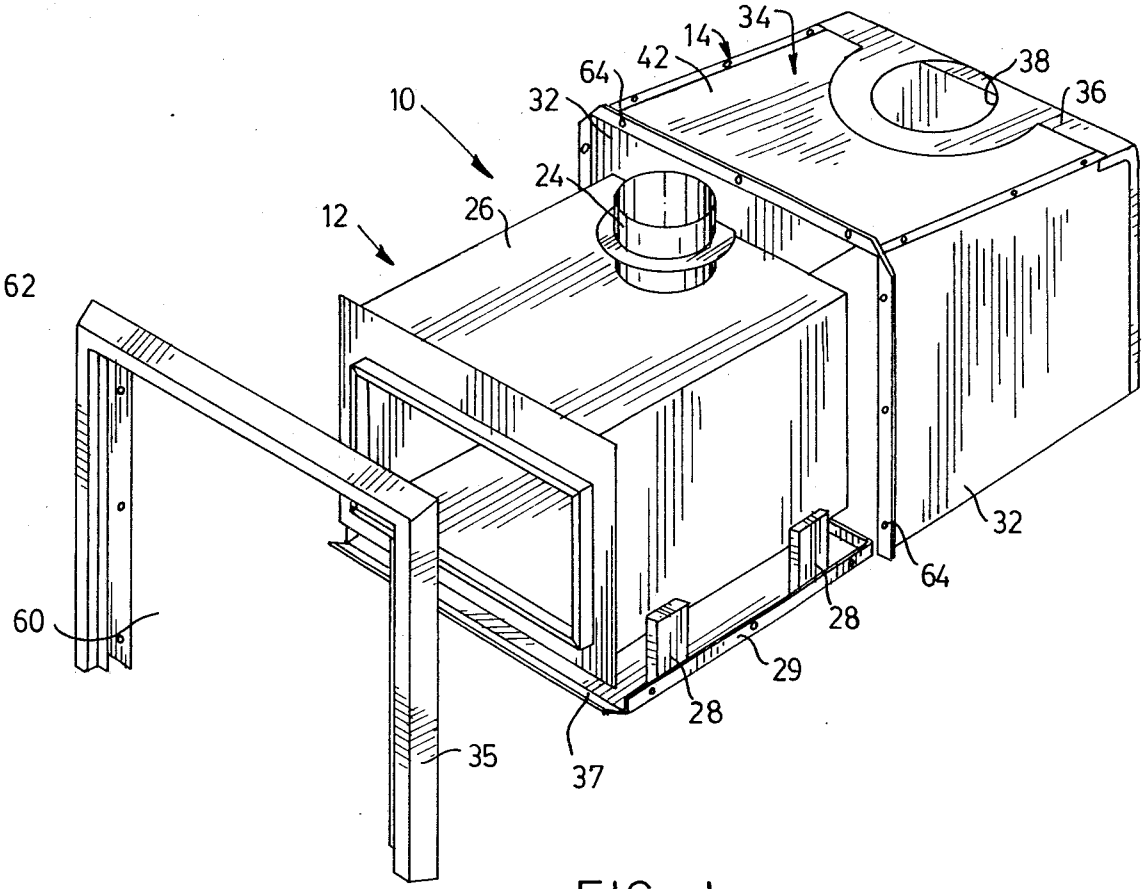
FIG. 1 is an "exploded" view in perspective of a fireplace insert heater assembly.
Figure 5:
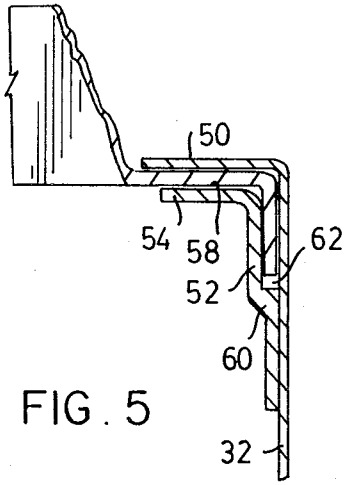
FIG. 5 is a detail of the sliding joint between an upper part and a side part of the cabinet.

In the drawings the fireplace insert heater assembly 10 comprises a firebox 12, a cabinet 14 and a joining means 16 for joining the heater to a flue shown at 18 in a chimney 20 rising from a fireplace 22.

The firebox 12 is of substantially conventional type and will not be described in detail. It may be mentioned however that it has an outlet for combustion products, which outlet is embodied in a stub pipe 24 arising from the back of the top portion 26 of the firebox. The firebox also comprises legs 28 of adjustable height to which are joined fore and aft disposed edge pieces 29.

Figure 3:
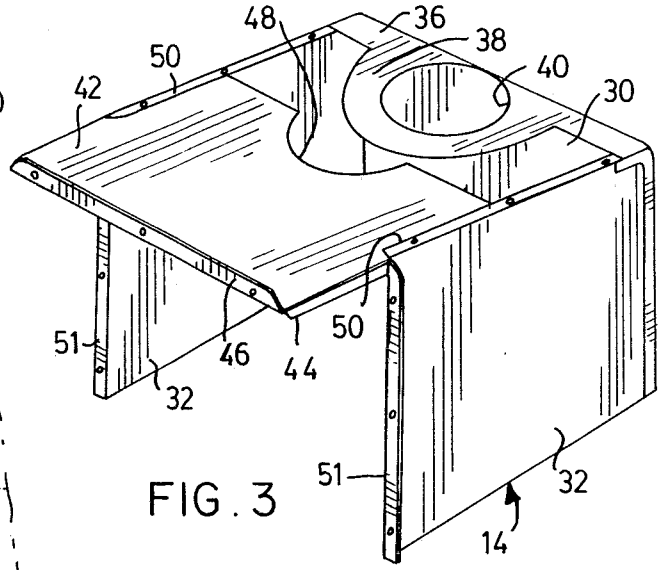
FIG. 3 is a perspective view of a cabinet forming part of the heater.
Figure 4:
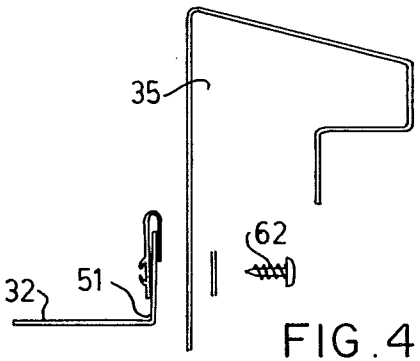
FIG. 4 is a detail of the manner of mounting the frame of the firebox door surround assembly forming part of the heater.
Figure 2:
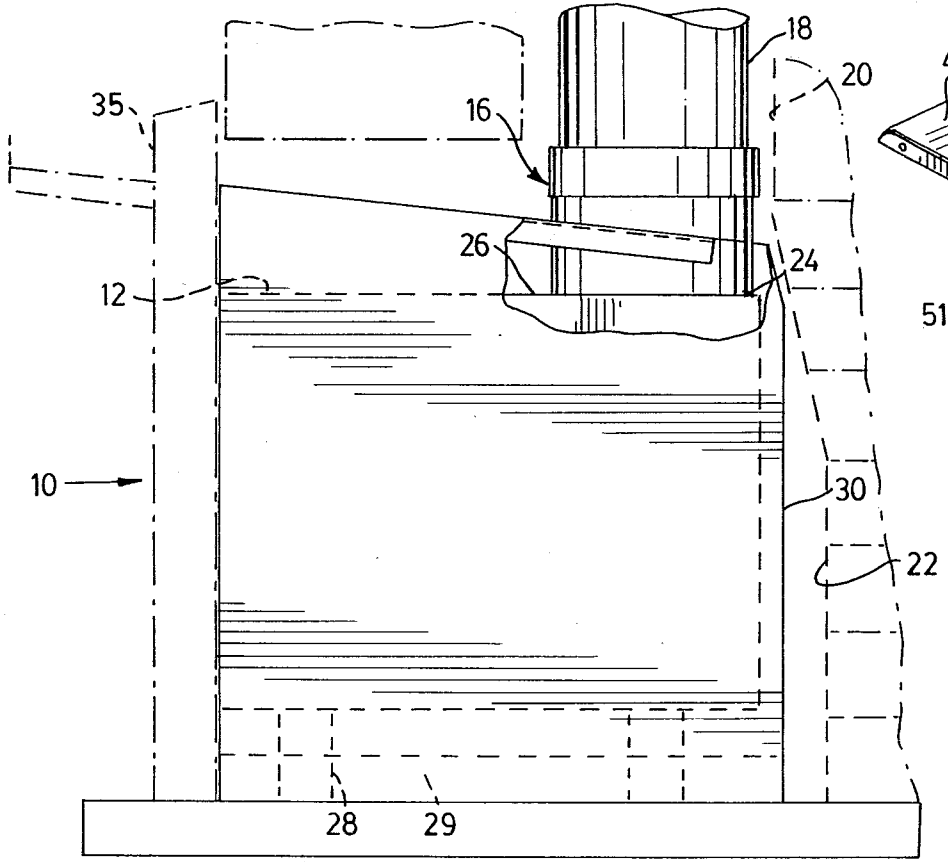
FIG. 2 is a somewhat schematic sectional side view of the heater installed in a fireplace.

The firebox is surrounded by a cabinet 14 which comprises a back panel 30, side panels 32, a top panel assembly 34, a bottom panel 37, and a door surround assembly 35. The back panel and side panels are joined together by any suitable means such as rivets or spot welding. The back panel is formed with a flanged portion 36 along its upper edge which flanged portion constitutes a part of the top panel assembly 34. The flanged portion 36 projects over the back of the top portion 26 of the firebox and terminates just forward of the position which will be occupied by the stub pipe 24 when the firebox is in position within the cabinet. The flanged portion as may be seen in FIG. 3 is substantially of omega shape having a central rounded portion 38 concentric with a circular cut-out 40 of diameter marginally greater than the diameter of the stub pipe 24 and through which the stub pipe projects in use.

The top panel assembly 34 also comprises a sliding plate 42. This plate is generally flat and rectangular but is provided with downwardly projecting flanges 44 along its side edges and an upwardly projecting flange 46 along its forward edge. At the centre of the rear edge is provided an approximately semi-circular cut-out 48 of diameter marginally greater than that of the stub pipe 24.

Projecting flanges 50 and 51 are formed on the upper and front edge respectively of each side panel. A joggled plate 52 with another inwardly projecting flange 54 is joined, as by rivetting, to each side plate close to and parallel to the upper edge thereof. There is however a vertical space 58 left between the flanges 50 and 54. Furthermore, the joggle 60 in the plate 52 serves to define a horizontal space 62 between the plate 52 and the side panel 32. The spaces 62 and 58 form a passage for the reception of the flanged side edge of sliding plate 42. Thus the side edges of the sliding plate 42 may be inserted in the front of the passages and the sliding plate can be pushed backwards with the side edges retained in the passages. The sliding plate is so dimensioned that the cut-out 48 is concentric with the cut-out 40 in the flanged portion 36 when the flange 46 in the sliding plate is coplanar with the flanges 51 in the side panels. The sliding plate 42 is stopped in this position by any convenient abutment such as the forward end of the flange 50 with which the flange 46 comes into contact.

The sliding plate 42 slopes downwardly from the front of the cabinet to the back.

The door surround assembly 35 is wider and higher than the front of the assembly comprising the aforementioned panels 30, 32, 34 and covers the gap which usually exists between the cabinet and the surrounding inner faces of the fireplace. It defines a large central aperture 60 which allows access to the front of the firebox in the conventional way. It is mounted on the flanges 50 and 51 of the side panels and sliding plate respectively by means of screws 62 which are received in holes 64 in the aforementioned flanges 50, 51. The screws are accessible from the front so that the door surround assembly is mountable when the cabinet and the firebox are in position.

Installation of the heater is carried out as follows. A flue 18 is mounted in the chimney and held in place by any suitable means. The sliding plate is removed from the cabinet. The cabinet and firebox are then inserted in the fireplace and a flue coupling clamp 68 positioned on the flue stub pipe 24. The legs 28 are adjusted until the firebox is at the correct height. Because of the fact that the sliding plate is removed it is now easy to get hold of the bottom end of the flue, push it into the flue stub, and tighten the sealing clamp 68 screw. The clamp 68 provides a positive connection between the flue and the flue stub and seals the joint therebetween.

Once the flue is properly joined to the stub pipe, the sliding plate can be slid into its correct position. The flanges 50 may be downwardly dimpled to provide an interference fit of the edges of the sliding plate in the passages serving to hold the sliding plate firmly in place. Recesses (not shown) may be provided by plates or the like riveted to the bottom face of the flanged portion 36 on either side of the cut out 40 for receiving the back edge of the sliding plate thereby enhancing the location thereof.

After the sliding plate has been positioned, the frame 35 is mounted by means of the screws 62 completing the installation of the described parts of which the heater is comprised.

Certain elements of the heater have not been described as they are not considered material to the invention. These include insulation elements which surround the cabinet, panel and trim pieces surrounding the front of the firebox; the front door itself of the firebox; and any backing plate required when frame 35 is too small to completely cover the fireplace opening.

The term flue includes any part of the discharge system for the products of combustion downstream of the heater.

I claim:

1. For a heater which is insertable at least partially in a fireplace through a fireplace opening and comprising a firebox having a front face, a flue stub extending outwardly from the firebox, and connecting means for connecting an outer end of the flue stub to a flue in situ in a chimney for conveying products of combustion away from the firebox, a cabinet arranged to at least partially enclose the firebox and being substantially the same size as the opening, the cabinet having an upper wall enclosing the flue stub under the connecting means, the wall having front and rear parts, the front part of which slopes downwardly from the front face of the fire box toward the connecting means and is movable when the cabinet is in situ to provide a space allowing access to the connecting means.

2. A cabinet according to claim 1, in which the movable front part is locatable substantially wholly within the fireplace.

3. A cabinet according to claim 1, and including a door assembly at least a portion of which is removable to allow access to the movable frost part.

4. A cabinet according to claim 1, and including guide formations in which the movable frost part can be slidably mounted.

5. A cabinet according to claim 1, in which the movable front part can be removed from the cabinet.

* * * * *